US011837168B2

(12) United States Patent
Heo et al.

(10) Patent No.: US 11,837,168 B2
(45) Date of Patent: Dec. 5, 2023

(54) LIGHT EMITTING DISPLAY DEVICE AND DRIVING METHOD THEREOF

(71) Applicant: LG DISPLAY CO., LTD., Seoul (KR)

(72) Inventors: Gwang Beom Heo, Paju-si (KR); Dong Ho Choi, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/965,905

(22) Filed: Oct. 14, 2022

(65) Prior Publication Data

US 2023/0206837 A1 Jun. 29, 2023

(30) Foreign Application Priority Data

Dec. 27, 2021 (KR) ..... 10-2021-0189029

(51) Int. Cl.
*G09G 3/3233* (2016.01)

(52) U.S. Cl.
CPC ... *G09G 3/3233* (2013.01); *G09G 2310/0291* (2013.01); *G09G 2320/02* (2013.01); *G09G 2320/041* (2013.01)

(58) Field of Classification Search
CPC ..... G09G 3/3233; G09G 2310/0291; G09G 2320/02; G09G 2320/041
See application file for complete search history.

(56) References Cited

U.S. PATENT DOCUMENTS

2016/0086540 A1* 3/2016 Kim ..... G09G 3/3275 345/214

* cited by examiner

*Primary Examiner* — Jonathan A Boyd
(74) *Attorney, Agent, or Firm* — POLSINELLI PC

(57) ABSTRACT

A light emitting display device includes a display panel for displaying an image, a driver for driving the display panel, and a temperature detector connected to anodes of organic light emitting diodes included in at least two sub-pixels positioned in the display panel, wherein the temperature detector detects at least two voltage values from the at least two sub-pixels and calculates a temperature measurement value for measuring a temperature of the display panel based on a difference between the at least two voltage values.

10 Claims, 13 Drawing Sheets

LIGHT EMITTING DISPLAY DEVICE AND DRIVING METHOD THEREOF

CROSS-REFERENCE TO RELATED APPLICATION

This application claims the priority of Korean Patent Application No. 10-2021-0189029, filed on Dec. 27, 2021, which is hereby incorporated by reference in its entirety.

BACKGROUND

Field of the Disclosure

The present disclosure relates to a light emitting display device and a driving method thereof.

DESCRIPTION OF THE BACKGROUND

With the development of information technology, the market for display devices, which are connection media between users and information, is growing. Accordingly, display devices such as a microLED display device, a light emitting display device, a quantum dot display device, and a liquid crystal display device are increasingly used.

The display devices described above include a display panel including sub-pixels, drivers that output driving signals for driving the display panel, and a power supply that generates power to be supplied to the display panel or the drivers, and the like.

In the aforementioned display devices, when driving signals, for example, a scan signal and a data signal, are supplied to sub-pixels formed in the display panel, selected sub-pixels transmit light or directly emit light to display an image.

SUMMARY

The present disclosure is to provide a light emitting display device that can maintain or improve display quality by directly measuring a temperature of a display panel based on a difference between voltages detected from at least two organic light emitting diodes and performing compensation depending on the temperature change.

To achieve these and other advantages and in accordance with the purpose of the present disclosure, as embodied and broadly described herein, a light emitting display device includes a display panel configured to display an image, a driver configured to drive the display panel, and a temperature detector connected to anodes of organic light emitting diodes included in at least two sub-pixels positioned in the display panel, wherein the temperature detector detects at least two voltage values from the at least two sub-pixels and calculates a temperature measurement value for measuring a temperature of the display panel based on a difference between the at least two voltage values.

The temperature detector may include a differential amplifier connected to the anodes of the organic light emitting diodes included in the at least two sub-pixels and outputting the difference between the at least two voltage values, and an amplifier configured to amplify and output the voltage difference output from the differential amplifier.

The temperature detector may further include a voltage reader configured to read only a voltage difference value at a time to be measured from an output terminal of the amplifier.

Different currents may be applied to the organic light emitting diodes included in the at least two sub-pixels such that a voltage difference is generated.

Amounts of currents applied to the organic light emitting diodes included in the at least two sub-pixels may be alternately varied.

The at least two sub-pixels may be adjacently disposed in a display area of the display panel or adjacently disposed in a non-display area of the display panel.

The light emitting display device may further include a timing controller configured to control the driver, wherein the timing controller compensates for a data signal to be supplied to the display panel based on the temperature measurement value transmitted from the temperature detector.

In another aspect of the present disclosure, a method for driving a light emitting display device includes applying current to organic light emitting diodes included in at least two sub-pixels formed in a display panel, detecting at least two voltage values from anodes of the organic light emitting diodes included in the at least two sub-pixels, calculating a difference between the at least two voltage values, calculating a temperature measurement value for measuring a temperature of the display panel based on the voltage difference, and compensating for a data signal to be supplied to the display panel based on the temperature measurement value.

The applying of currents to the organic light emitting diodes may include applying different currents such that a voltage difference is generated between the organic light emitting diodes included in the at least two sub-pixels.

Amounts of currents applied to the organic light emitting diodes included in the at least two sub-pixels may be alternately varied.

The present disclosure can maintain display quality uniform or improve the display quality by directly measuring the temperature of the display panel based on a difference between voltages detected from at least two organic light emitting diodes and performing compensation depending on temperature change.

In addition, the present disclosure can remove process deviation during measurement of the temperature of the display panel and calculate only pure temperature measurement values to improve measurement accuracy.

It is to be understood that both the foregoing general description and the following detailed description are exemplary and explanatory and are intended to provide further explanation of the disclosure as claimed.

BRIEF DESCRIPTION OF THE DRAWINGS

The accompanying drawings, which are included to provide a further understanding of the present disclosure and are incorporated in and constitute a part of the present disclosure, illustrate aspects of the present disclosure and together with the description serve to explain the principle of the present disclosure.

In the drawings.

DETAILED DESCRIPTION

The display device according to the present disclosure—may be implemented as a television, a video player, a personal computer (PC), a home theater, an automobile electric device, a smartphone, and the like, but is not limited thereto. The display device according to the present disclosure may be implemented as a light emitting display (LED) device, a quantum dot display (QDD) device, a liquid crystal display (LCD) device (LCD), or the like. However, hereinafter, a light emitting display device that directly emits light based on inorganic light emitting diodes or organic light emitting diodes will be exemplified for convenience of description.

Figure 1:
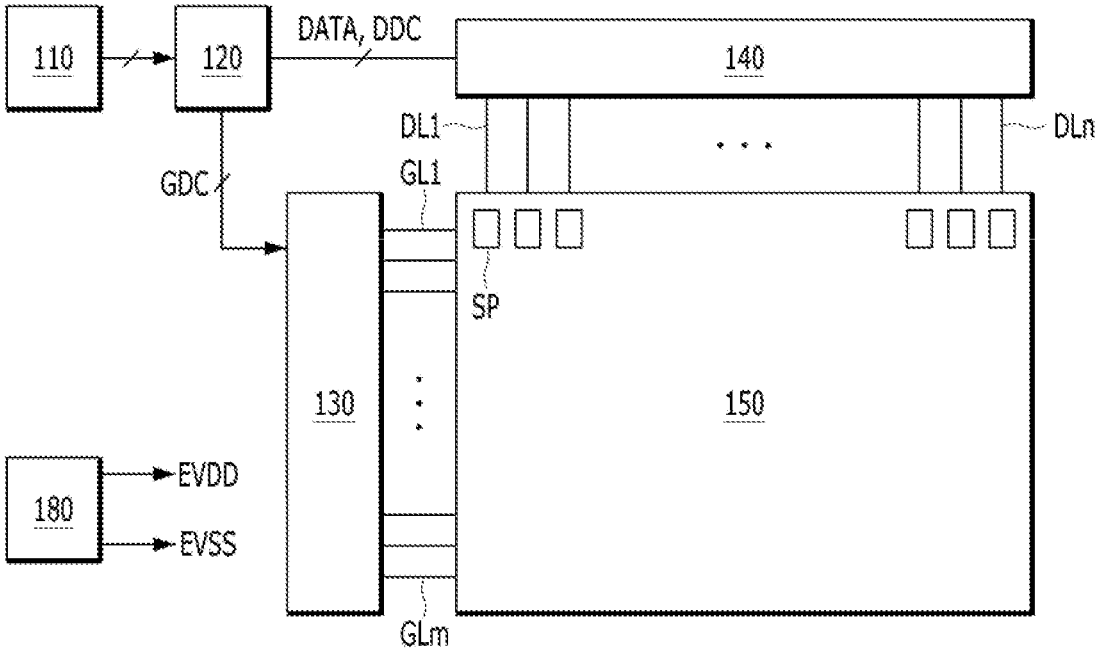
FIG. 1 is a block diagram schematically illustrating a light emitting display device.
Figure 2:
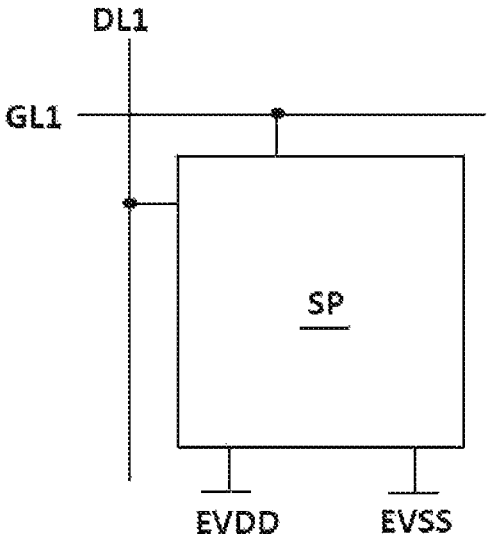
FIG. 2 is a configuration diagram schematically illustrating a sub-pixel illustrated in FIG. 1.

FIG. 1 is a block diagram schematically illustrating a light emitting display device, and FIG. 2 is a configuration diagram schematically illustrating a sub-pixel shown in FIG. 1.

As shown in FIGS. 1 and 2, the light emitting display device may include an image provider 110, a timing controller 120, a scan driver 130, a data driver 140, a display panel 150, a power supply 180, and the like.

The image provider (i.e., set or host system) 110 may output various driving signals along with an image data signal supplied from the outside or an image data signal stored in an internal memory. The image provider 110 may supply a data signal and various driving signals to the timing controller 120.

The timing controller 120 may output a gate timing control signal GDC for controlling the operation timing of the scan driver 130, a data timing control signal DDC for controlling the operation timing of the data driver 140, and various synchronization signals (vertical synchronization signal Vsync and horizontal synchronization signal Hsync). The timing controller 120 may supply a data signal DATA supplied from the image provider 110 along with the data timing control signal DDC to the data driver 140. The timing controller 120 may take the form of an integrated circuit (IC) and be mounted on a printed circuit board, but is not limited thereto.

The scan driver 130 may output a scan signal (or a scan voltage) in response to the gate timing control signal GDC supplied from the timing controller 120. The scan driver 130 may supply scan signals to sub-pixels included in the display panel 150 through gate lines GL1 to GLm. The scan driver 130 may be take the form of an IC or may be directly formed on the display panel 150 in a gate-in-panel structure, but is not limited thereto.

The data driver 140 may sample and latch the data signal DATA in response to the data timing control signal DDC supplied from the timing controller 120, convert the digital data signal into an analog data voltage based on a gamma reference voltage, and output the analog data voltage. The data driver 140 may supply a data voltage to the sub-pixels included in the display panel 150 through data lines DL1 to DLn. The data driver 140 may take form of an IC and be mounted on the display panel 150 or mounted on a printed circuit board, but is not limited thereto.

The power supply 180 may generate first power having high potential and second power having low potential based on external input power supplied from the outside, and output the first power and the second power through a first power line EVDD and a second power line EVSS. The power supply 180 may generate and output voltages (e.g., gate voltages including a gate high voltage and a gate low voltage) necessary to drive the scan driver 130 and voltages (drain voltages including a drain voltage and a half drain voltage) necessary to drive the data driver 140 as well as the first power and the second power.

The display panel 150 may display an image in response to driving signals including a scan signal and a data voltage, a first power, the second power, and the like. The sub-pixels of the display panel 150 directly emit light. The display panel 150 may be manufactured based on a substrate having rigidity or flexibility, such as glass, silicon, polyimide, or the like. In addition, the sub-pixels that emit light may include red, green, and blue pixels or include red, green, blue, and white pixels.

For example, one sub-pixel SP may be connected to the first data line DL1, the first gate line GL1, the first power line EVDD, and the second power line EVSS and may include a pixel circuit including a switching transistor, a driving transistor, a capacitor, an organic light emitting diode, and the like. Since the sub-pixel SP used in the light emitting display device directly emits light, the circuit configuration is complicated. In addition, there are various compensation circuits for compensating for deterioration of a driving transistor for supplying a driving current necessary to drive organic light emitting diodes emitting light as well as the organic light emitting diodes. Accordingly, it is noted that the sub-pixel SP is simply illustrated in the form of a block.

Meanwhile, in the above description, the timing controller 120, the scan driver 130, the data driver 140, and the like are described as individual components. However, depending on the implementation method of the light emitting display device, one or more of the timing controller 120, the scan driver 130, and the data driver 140 may be integrated into one IC.

Figure 3:
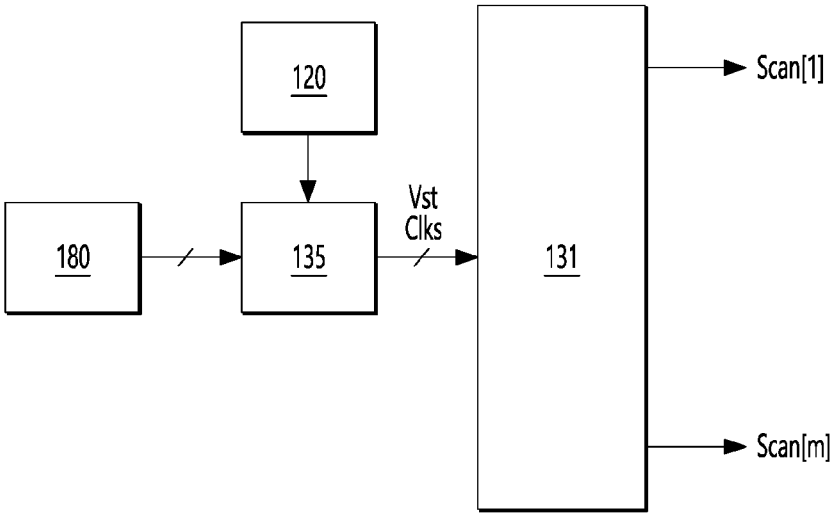
FIGS. 3 and 4 are diagrams for describing a configuration of a gate-in-panel type scan driver.
Figure 4:
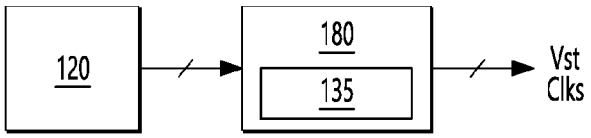
Figure 5A:
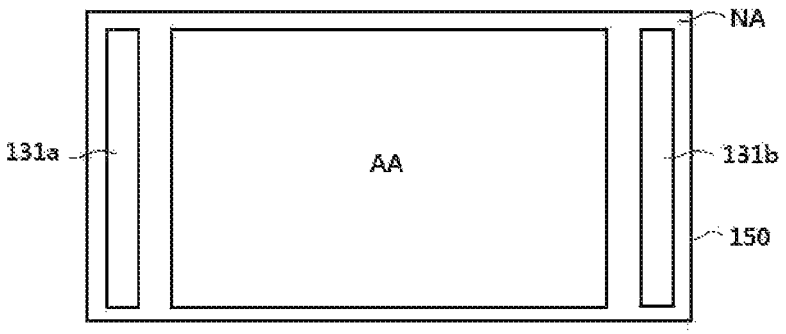
FIGS. 5A and 5B are diagrams illustrating an arrangement example of the gate-in-panel type scan driver.
Figure 5B:
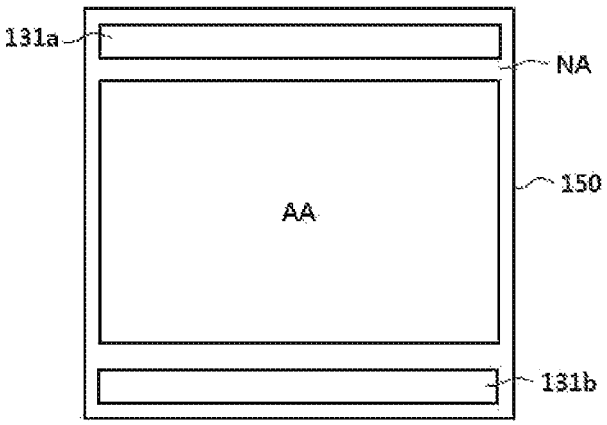

FIGS. 3 and 4 are diagrams for describing a configuration of a gate-in-panel type scan driver, FIGS. 5A and 5B are diagrams illustrating an arrangement example of the gate-in-panel type scan driver, and FIG. 6 is an exemplary diagram showing the shape of a display panel.

As shown in FIG. 3, the gate-in-panel type scan driver 130 may include a shift register 131 and a level shifter 135. The level shifter 135 may generate driving clock signals Clks and a start signal Vst based on signals and voltages output from the timing controller 120 and the power supply 180. The driving clock signals Clks may be generated in the form of j different phases (j being an integer equal to or greater than 2) such as 2 phases, 4 phases, or 8 phases.

The shift register 131 operates based on the signals Clks and Vst output from the level shifter 135 and may output scan signals Scan[1] to Scan [m] for turning on or off transistors formed in the display panel. The shift register 131 may take the form of a thin film on the display panel in a gate-in-panel (GIP) structure.

As shown in FIGS. 3 and 4, unlike the shift register 131, the level shifter 135 may be independently configured as an IC or may be included in the power supply 180. However, this is merely an example and the present disclosure is not limited thereto.

As shown in FIGS. 5A and 5B, shift registers 131*a* and 131*b* outputting scan signals in the gate-in-panel type scan driver may be disposed in a non-display area NA of the display panel 150. The shift registers 131*a* and 131*b* may be disposed in left and right non-display areas NA of the display panel 150 as shown in FIG. 5A or in upper and lower non-display areas NA of the display panel 150 as shown in FIG. 5B. Although an example in which the shift registers 131*a* and 131*b* are disposed in the non-display areas NA is illustrated in FIGS. 5A and SB, the present disclosure is not limited thereto.

Figure 6A:
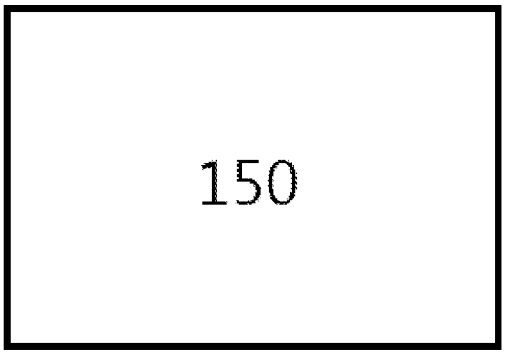
FIGS. 6A, 6B, 6C and 6D are exemplary diagrams showing the shape of a display panel.
Figure 6B:
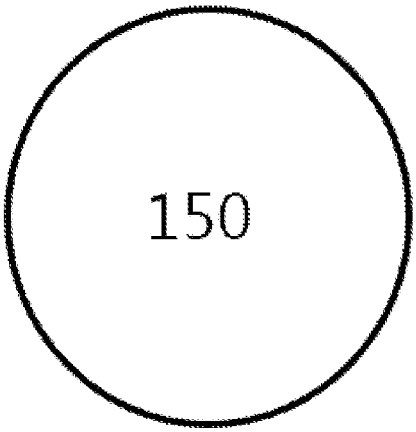
Figure 6C:
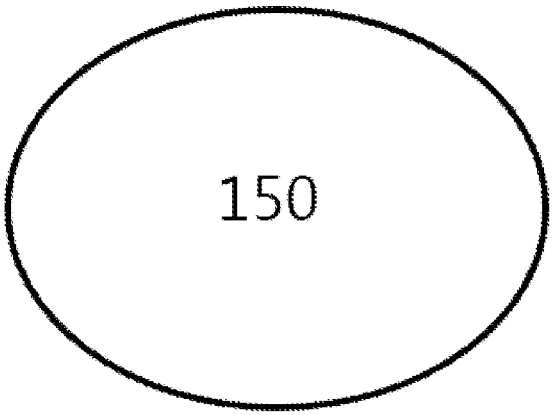
Figure 6D:
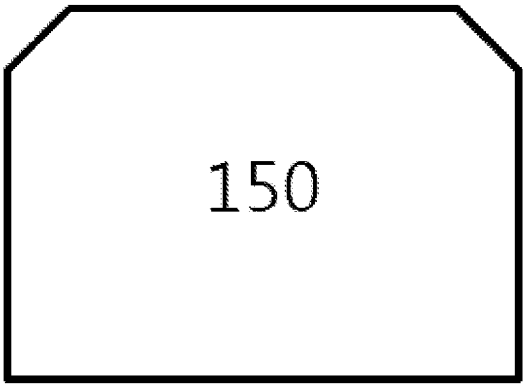

As shown in FIGS. 6A-6D, the display panel 150 may be implemented in various shapes such as a rectangle (or a square) (a), a circle (b), an oval (c), and a hexagon (d). The display panels 150 shown by FIGS. 6A, 6B, 6C and 6D, except for the generally widely used rectangular display panel 150 as shown by FIG. 6A, are also called heteromorphic display panels because they have different shapes (shapes different from a normal shape).

Figure 7:
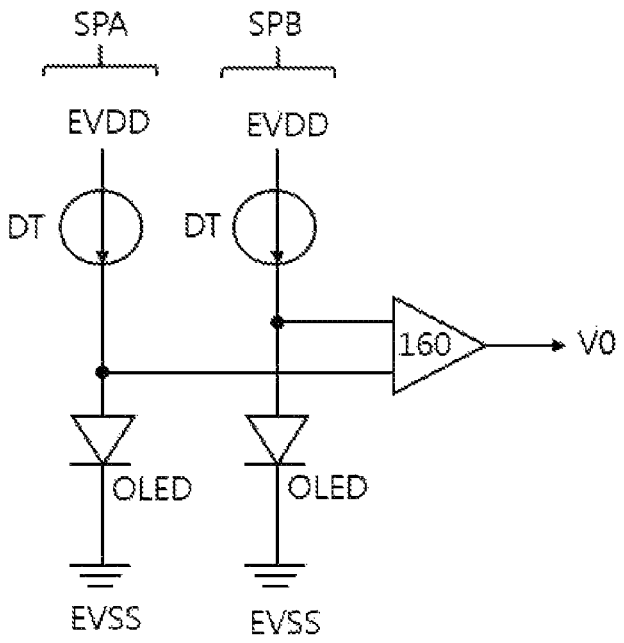
FIG. 7 is a temperature measurement circuit according to an aspect of the present disclosure.
Figure 8:
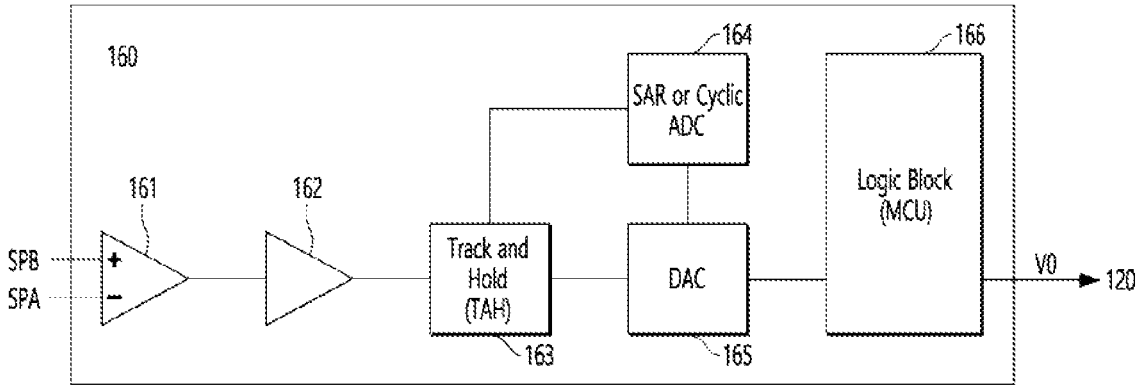
FIG. 8 is an exemplary configuration diagram of a temperature detector shown in FIG. 7.
Figure 9:
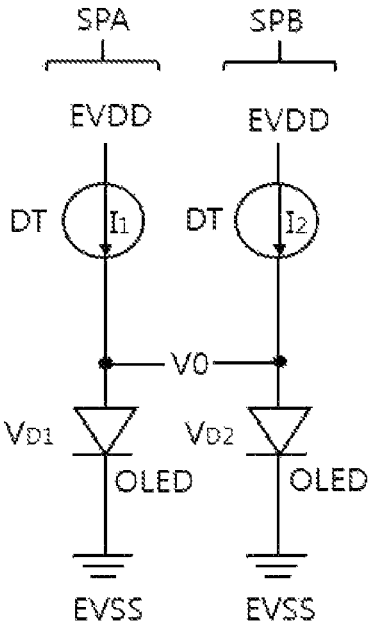
FIG. 9 is a diagram for describing a temperature measurement method using a difference between voltages detected from two organic light emitting diodes.

FIG. 7 illustrates a temperature measurement circuit according to an aspect of the present disclosure, FIG. 8 is an exemplary configuration diagram of a temperature detector shown in FIG. 7, and FIG. 9 is a temperature measurement method using a difference between voltages detected from two organic light emitting diodes.

As shown in FIG. 7, the temperature measurement circuit according to an aspect of the present disclosure may include at least two sub-pixels SPA and SPB and a temperature detector 160. Each of the at least two sub-pixels SPA and SPB may include a driving transistor DT and an organic light emitting diode OLED positioned between the first power line EVDD and the second power line EVSS.

The temperature detector 160 detects a first voltage value from the anode of the organic light emitting diode OLED included in the first sub-pixel SPA and a second voltage value from the anode of the organic light emitting diode OLED included in the second sub-pixel SPB. The temperature detector 160 may calculate a difference between the first voltage value and the second voltage value detected from the first sub-pixel SPA and the second sub-pixel SPB, and measure the temperature of the display panel based thereon. Meanwhile, it is to be noted that the configuration of the first sub-pixel SPA and the second sub-pixel SPB illustrated in FIG. 7 shows only a simplified equivalent circuit for better understanding of the present disclosure.

As shown in FIGS. 7 and 8, the temperature detector 160 may include a differential amplifier 161, an amplifier 162, a voltage reader 163 (Track and Hold (TAH)), an AD converter 164 (SAR or Cyclic ADC), a DA converter 165 (DAC), a controller 166 (Logic Block (MCU)), etc.

The differential amplifier 161 may have an inverting terminal (−) connected to the anode of the organic light emitting diode OLED included in the first sub-pixel SPA, a non-inverting terminal (+) connected to the anode of the organic light emitting diode OLED included in the second sub-pixel SPB (connection relationship opposite to the previous one is also possible), and an output terminal connected to an input terminal of the amplifier 162. The differential amplifier 161 may calculate and output a difference between the first voltage value and the second voltage value detected from the first sub-pixel SPA and the second sub-pixel SPB.

The amplifier 162 may have the input terminal connected to an output terminal of the differential amplifier 161 and an output terminal connected to an input terminal of the voltage reader 163. The amplifier 162 may amplify and output the voltage difference output from the differential amplifier 161.

The voltage reader 163 may have the input terminal connected to the output terminal of the amplifier 162 and an output terminal connected to an input terminal of the AD converter 164. The voltage reader 163 may be provided to read only a voltage difference value at the time to be measured from the output terminal of the amplifier 162. In this way, when the voltage reader 163 is provided, the operation of detecting voltages from the first sub-pixel SPA and the second sub-pixel SPB may be repeated N (N being an integer equal to or greater than 1) times at predetermined intervals.

The AD converter 164 may have an input terminal connected to the output terminal of the voltage reader 163 and an output terminal connected to an input terminal of the DA converter 165. The AD converter 164 may convert the analog voltage difference value output from the voltage reader 163 into a digital voltage difference value and output the same. The AD converter 164 may be implemented in the form of a successive approximation (SAR) ADC or a cyclic ADC.

The DA converter 165 may have the input terminal connected to the output terminal of the AD converter 164 and an output terminal connected to the input terminal of the voltage reader 163. The DA converter 165 may convert the digital voltage difference value output from the AD converter 164 into an analog voltage difference value and transmit the same to the voltage reader 163.

In the above description, a configuration in which a voltage measurement value can be continuously circulated based on the voltage reader 163, the AD converter 164, and the DA converter 165 to simplify the device while increasing the precision (accuracy) of temperature measurement when the temperature measurement circuit is implemented is exemplified.

If the circuit is implemented in a configuration in which a voltage difference value can be continuously circulated in this manner, fine measurement down to the fifth decimal place is possible, and thus a temperature from −40° C. to 120° C. can be represented. However, the configuration of FIG. 8 is merely an example, and the present disclosure is not limited thereto.

The controller 166 may measure the temperature of the display panel based on the digital voltage difference value output from the AD converter 164. The controller 166 may apply the digital voltage difference value to an algorithm including a formula provided therein, and output a temperature measurement value of the display panel based thereon.

The temperature measurement value V0 output from the controller 166 may be transmitted to the timing controller 120. The controller 166 may transmit the temperature measurement value V0 calculated at a specific time in a specific period under specific conditions to the timing controller 120.

The timing controller 120 may perform compensation depending on temperature change based on the temperature measurement value V0. In this case, the timing controller 120 may compensate for a data signal, power, gamma, etc. based on the temperature measurement value V0, but is not limited thereto. In addition, the controller 166 may be included in the timing controller 120.

As shown in FIG. 9, the driving transistors DT included in the two sub-pixels SPA and SPB may generate currents I1 and I2. The driving transistors DT may generate the first and second currents which are different (I1≠I2) such that a voltage difference is generated between the anodes of the organic light emitting diodes OLED. Here, a voltage difference may be generated between the two organic light emitting diodes OLEDs to which the first and second currents which are different (I1≠I2) are applied, and this voltage value may be proportional to an absolute temperature.

In addition, voltages VD1 and VD2 corresponding to the currents may be generated in the anodes of the organic light emitting diodes OLED included in the two sub-pixels SPA and SPB. Here, the two sub-pixels SPA and SPB may alternately and variably control the amounts of currents applied to the organic light emitting diodes OLED to prevent or minimize the effect of deterioration due to the currents. That is, the amounts of currents applied to the two organic light emitting diodes OLED may be alternately changed.

When a temperature measurement value is calculated based on the voltage difference obtained from the anodes of the organic light emitting diodes OLED included in the two sub-pixels SPA and SPB, the following equations may be used.

$$V_D = Vth\left\{\ln\left(\frac{I}{I_0}\right)\right\} = \frac{kT}{q}\left\{\ln\left(\frac{I}{I_0}\right)\right\} \quad \text{[Equation 1]}$$

Equation 1 represents a voltage value obtainable from the anode of an organic light emitting diode OLED. In Equation 1, Vth denotes the threshold voltage of the organic light emitting diode OLED, k and q denote constants, T denotes temperature, I denotes current, and $V_D$ is proportional to an absolute temperature T.

Further, in Equation 1, $I_0$ is a value (temperature effect offset value due to process dispersion) for removing process deviation during manufacture of an organic light emitting diode OLED and calculating only a pure temperature value. This is represented by Equation 2.

$$I_0 = qA\left\{\frac{D_n ni^2}{L_n N_A} + \frac{D_p ni^2}{L_p N_D}\right\} \quad \text{[Equation 2]}$$

In Equation 2, q denotes the amount of charge, A denotes the area, $D_O ni^2$ represents the N-type dopant and its intrinsic concentration, $D_p ni^2$ represents the P-type dopant and its intrinsic concentration, $L_n N_A$ represents the acceptor, and $L_p N_D$ represents the donor.

When Equations 1 and 2 described above are applied to the circuit of FIG. 9 and an equation for obtaining the temperature measurement value V0 is established based thereon, the following Equation 3 is obtained.

$$V_O = V_{D1} - V_{D2} = \frac{kT}{q}\left\{\ln\left(\frac{I_1}{I_0}\right)\right\} - \frac{kT}{q}\left\{\ln\left(\frac{I_2}{I_0}\right)\right\} \quad \text{[Equation 3]}$$

In Equation 3, $V_{D1}$ denotes the voltage of the OLED of the first sub-pixel SPA of FIG. 9, $V_{D2}$ denotes the voltage of the OLED of the second sub-pixel SPB of FIG. 9, and k and q are constants, T is temperature, $I_1$ represents the first current for driving the OLED of the first sub-pixel SPA, and $I_2$ represents the second current for driving the OLED of the second sub-pixel SPB.

In addition, Equation 3 may be simply rearranged as Equation 4.

$$V_O = V_{D1} - V_{D2} = \frac{kT}{q}\left\{\ln\left(\frac{I_1}{I_2}\right)\right\} \quad \text{[Equation 4]}$$

As can be ascertained from the above description, the aspect of the present disclosure can remove process deviation and calculate only a pure temperature measurement value, that is, an absolute temperature based on a difference between voltage values detected from the two organic light emitting diodes OLED.

Figure 10:
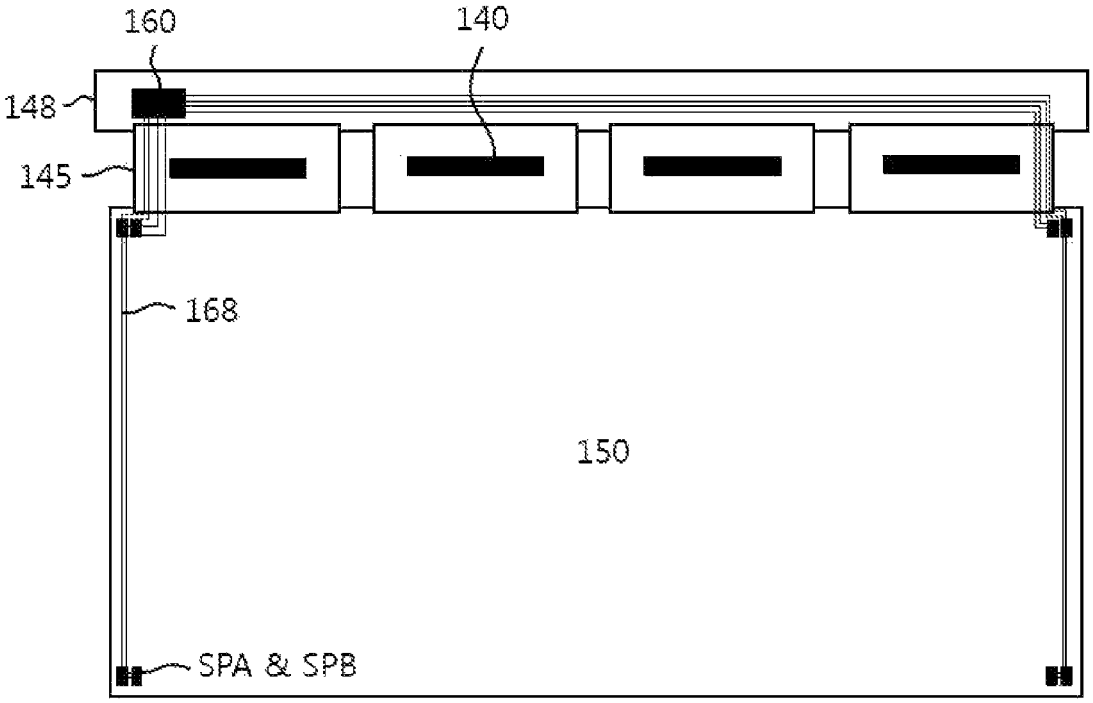
FIG. 10 is an exemplary diagram illustrating implementation of the temperature measurement circuit according to an aspect of the present disclosure.

FIG. 10 is an exemplary diagram illustrating implementation of the temperature measurement circuit according to an aspect of the present disclosure, and FIGS. 11 to 14 are exemplary diagrams illustrating other implementations of the temperature measurement circuit according to the aspect of the present disclosure.

As shown in FIG. 10, according to an aspect of the present disclosure, the first and second sub-pixels SPA and SPB included in the temperature measurement circuit may be disposed at respective corners of the display panel 150. That is, the first and second sub-pixels SPA and SPB provided as a pair may be disposed at each corner of the display panel 150.

The temperature detector 160 may be disposed on a printed circuit board 148. The printed circuit board 148 may be electrically connected to the display panel 150 through a flexible circuit board 145 on which the data driver 140 is mounted. The temperature detector 160 may be electrically connected to the sub-pixels SPA and SPB based on wires 168 disposed on the printed circuit board 148, the flexible circuit board 145, and the display panel 150.

When the first and second sub-pixels SPA and SPB provided as a pair are disposed at each corner of the display panel 150 as described above, temperature change in the entire area of the display panel 150 can be directly measured more precisely.

Figure 11:
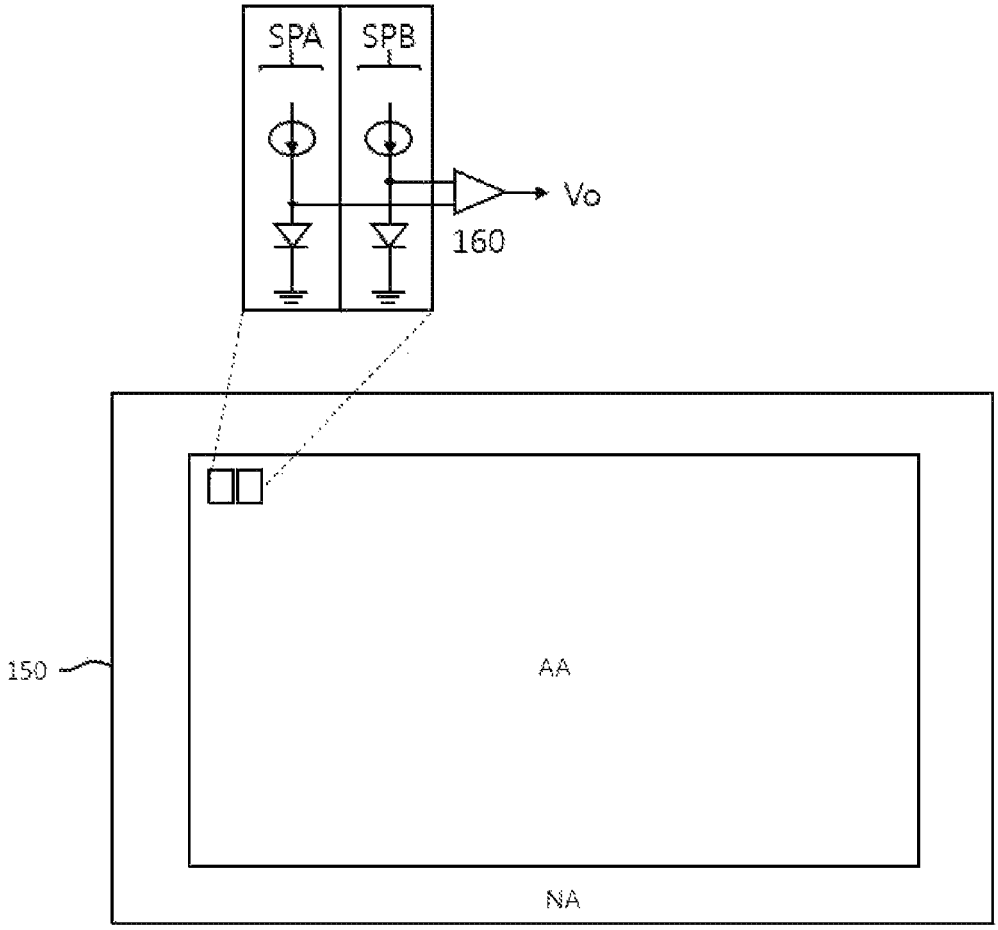
FIGS. 11 to 14 are exemplary diagrams illustrating other implementations of the temperature measurement circuit according to the present disclosure.
Figure 12:
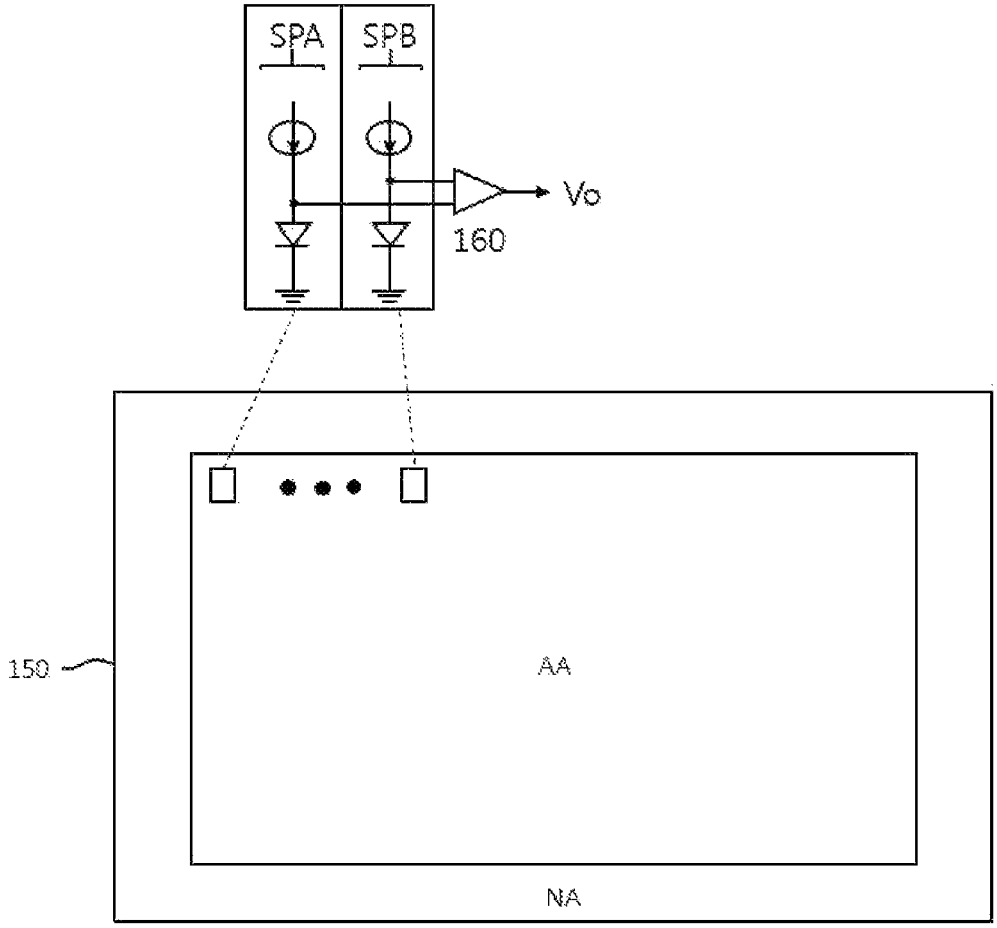

As shown in FIG. 11, according to an aspect of the present disclosure, the temperature detector 160 may measure a temperature based on two sub-pixels SPA and SPB adjacently formed in a display area AA of the display panel 150. As shown in FIG. 12, according to the aspect of the present disclosure, the temperature detector 160 may measure a temperature based on two sub-pixels SPA and SPB formed to be spaced apart from each other in the display area AA of the display panel 150.

In the examples of FIGS. 11 and 12, the two sub-pixels SPA and SPB formed in the display area AA are used as they are. Since this method can be implemented only by adding more wires to the two sub-pixels SPA and SPB, advantages in terms of processing can be obtained.

Figure 13:
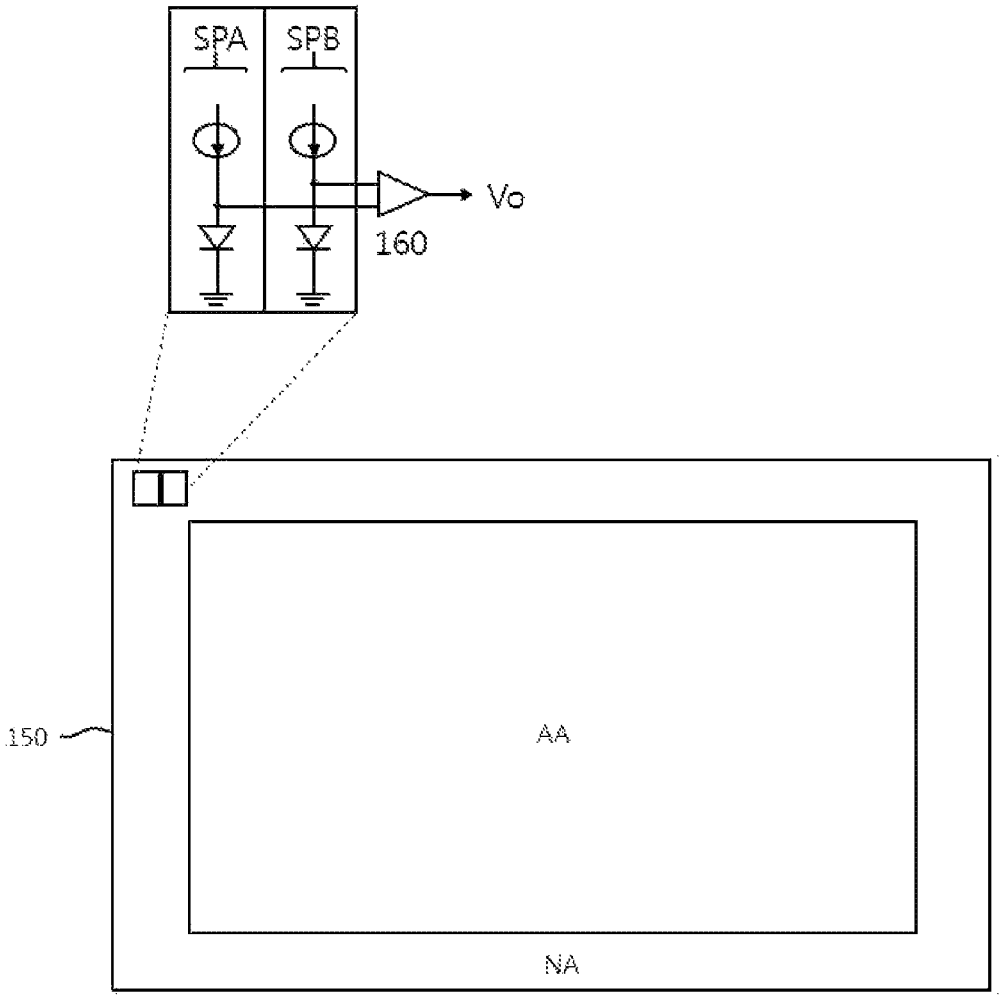
Figure 14:
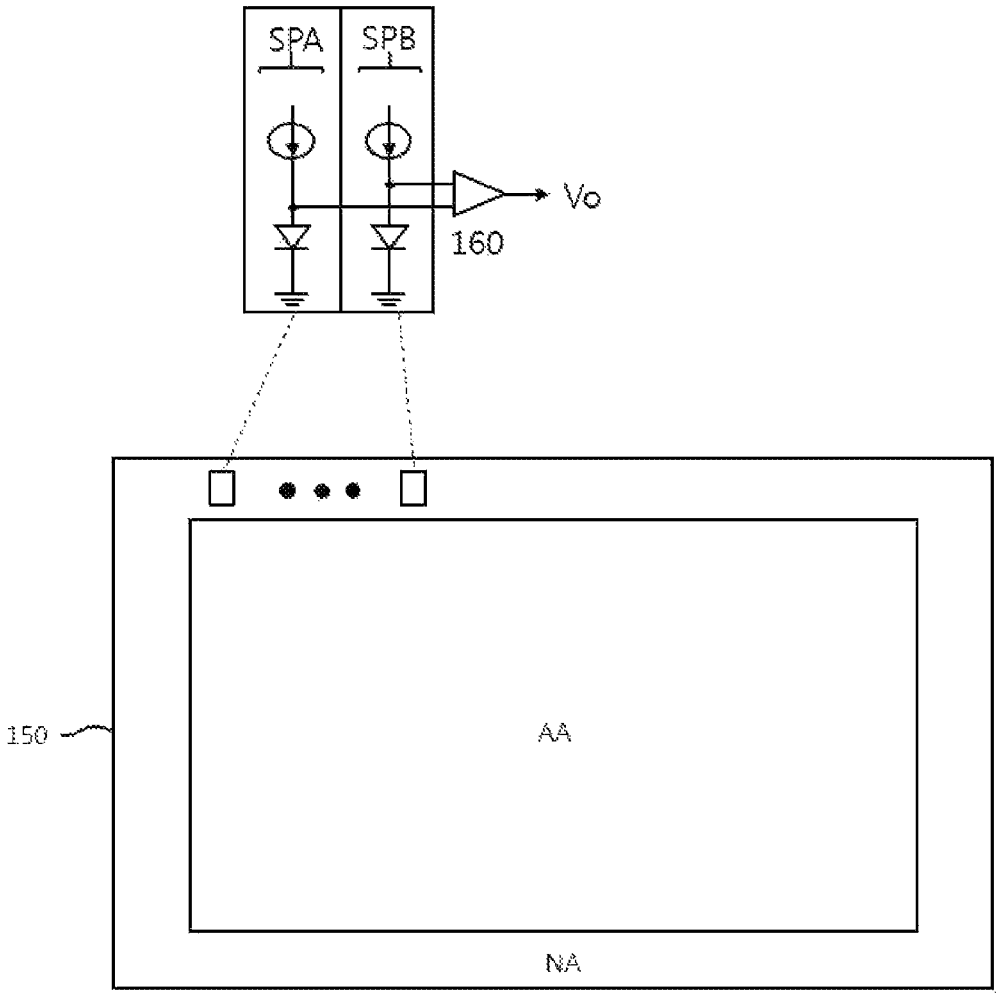

As shown in FIG. 13, according to an aspect of the present disclosure, the temperature detector 160 may measure a temperature based on two sub-pixels SPA and SPB adjacently formed in a non-display area NA of the display panel 150. As shown in FIG. 14, according to an aspect of the present disclosure, the temperature detector 160 may measure a temperature based on two sub-pixels SPA and SPB formed to be spaced apart from each other in the non-display area NA of the display panel 150.

In the examples of FIGS. 13 and 14, two dummy sub-pixels SPA and SPB are formed in the non-display area NA and used. Although this method requires two additional dummy sub-pixels SPA and SPB along with wires, the temperature can be measured regardless of an image display operation.

The temperature measurement circuit may be implemented based on one of a sub-pixel that actually emits light and is used for image representation or a sub-pixel (dummy sub-pixel) that actually emits light but is not used for image representation depending on an implementation target as well as the structural characteristics or driving characteristics of the display panel. The dummy sub-pixel used for temperature measurement may be implemented based on the same circuit as the sub-pixel, but unlike the sub-pixel, it may be implemented based on a simplified circuit since only a current is applied.

Meanwhile, it is desirable to detect voltage values from two dummy sub-pixels SPA and SPB arranged adjacent to each other in order to increase measurement accuracy during temperature detection using the temperature measurement circuit. However, even when voltage values are detected from the two dummy sub-pixels SPA and SPB spaced apart from each other by a predetermined interval, the same voltage values as those in the former case can be obtained. Accordingly, it is desirable to consider this when voltage values are detected from two dummy sub-pixels SPA and SPB spaced apart from each other.

As described above, according to the present disclosure, it is possible to maintain display quality uniform or improve the display quality by directly measuring the temperature of the display panel based on a difference between voltage values detected from at least two organic light emitting diodes and performing compensation depending on temperature change. In addition, the present disclosure can improve measurement accuracy by removing process deviation during measurement of the temperature of the display panel and calculating only a pure temperature measurement value.

What is claimed is:

1. A light emitting display device comprising:

a display panel configured to display an image;

a driver configured to drive the display panel; and a temperature detector connected to anodes of organic light emitting diodes included in at least two sub-pixels positioned in the display panel, wherein the temperature detector configured to detect at least two voltage values from the at least two sub-pixels and calculate a temperature measurement value for measuring a temperature of the display panel based on a voltage difference between the at least two voltage values, wherein the temperature detector includes:

a differential amplifier connected to the anodes of the organic light emitting diodes included in the at least two sub-pixels and outputting the voltage difference between the at least two voltage values;

an amplifier configured to amplify and output the voltage difference output from the differential amplifier, a voltage reader configured to read the voltage difference at time to be measured from the output terminal of the amplifier, an AD converter configured to convert the voltage difference output from the voltage reader into a digital voltage difference, and a DA converter configured to convert the digital voltage difference output from the AD converter into an analog voltage difference, wherein the temperature detector continuously circulates the voltage difference based on the voltage reader, the AD converter, and the DA converter in order to increase the accuracy of the temperature measurement.

2. The light emitting display device according to claim 1, wherein the organic light emitting diodes included in the at least two sub-pixels receive different currents to generate the voltage difference.

3. The light emitting display device according to claim 1, wherein the organic light emitting diodes included in the at least two sub-pixels receive amounts of currents that are alternately varied.

4. The light emitting display device according to claim 1, wherein the at least two sub-pixels are adjacently disposed in a display area of the display panel or adjacently disposed in a non-display area of the display panel.

5. The light emitting display device according to claim 1, further comprising a timing controller configured to control the driver, wherein the timing controller compensates for a data signal to be supplied to the display panel based on the temperature measurement value transmitted from the temperature detector.

6. The light emitting display device according to claim 1, wherein the voltage reader includes an input terminal connected to a output terminal of the amplifier and an output terminal connected to an input terminal of the AD converter, the AD converter includes the input terminal connected to the output terminal of the voltage reader and an output terminal connected to an input terminal of the DA converter, and the DA converter includes the input terminal connected to the output terminal of the AD converter and an output terminal connected to the input terminal of the voltage reader.

7. The light emitting display device according to claim 1, wherein the at least two sub-pixels are disposed at each corner of the non-display area of the display panel.

8. A method for driving the light emitting display device of claim 1, comprising:

applying current to the organic light emitting diodes included in the at least two sub-pixels formed in the display panel;

detecting the at least two voltage values from the anodes of the organic light emitting diodes included in the at least two sub-pixels;

calculating the voltage difference between the at least two voltage values;

calculating the temperature measurement value for measuring the temperature of the display panel based on the voltage difference; and compensating for a data signal to be supplied to the display panel based on the temperature measurement value.

9. The method according to claim 8, wherein the applying current to the organic light emitting diodes comprises applying different currents such that the voltage difference is generated between the organic light emitting diodes included in the at least two sub-pixels.

10. The method according to claim 9, wherein the organic light emitting diodes included in the at least two sub-pixels receive amounts of currents that are alternately varied.

* * * * *